United States Patent [19]

Ohotnicky

[11] 3,972,096

[45] Aug. 3, 1976

[54] FELTING NEEDLE

[75] Inventor: Edward A. Ohotnicky, Torrington, Conn.

[73] Assignee: The Torrington Company, Torrington, Conn.

[22] Filed: Oct. 16, 1974

[21] Appl. No.: 515,323

[52] U.S. Cl. ..... 28/4 N
[51] Int. Cl.[2] ..... D04H 18/00
[58] Field of Search ..... 28/4 N

[56] References Cited

UNITED STATES PATENTS 2,873,507 2/1959 Kelson ..... 28/4 N
3,792,512 2/1974 Zocher ..... 28/4 N

FOREIGN PATENTS OR APPLICATIONS 6,803,377 9/1968 Netherlands ..... 28/4 N

*Primary Examiner*—Louis K. Rimrodt
*Attorney, Agent, or Firm*—Frank S. Troidl

[57] ABSTRACT

This is a felting needle with one or more of the throats of the barbs extending into the pointed end of the needle. The throat surface is at an angle with respect to the axis of the needle.

1 Claim, 7 Drawing Figures

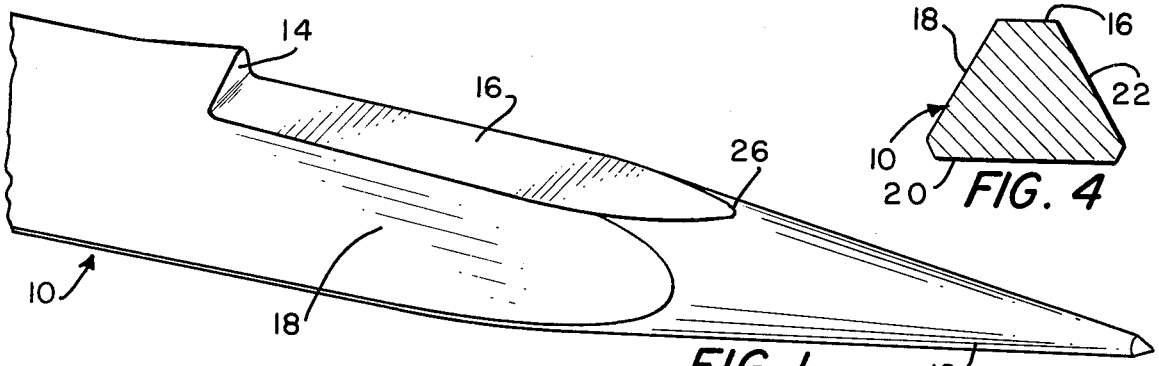
FIG. 1
FIG. 4
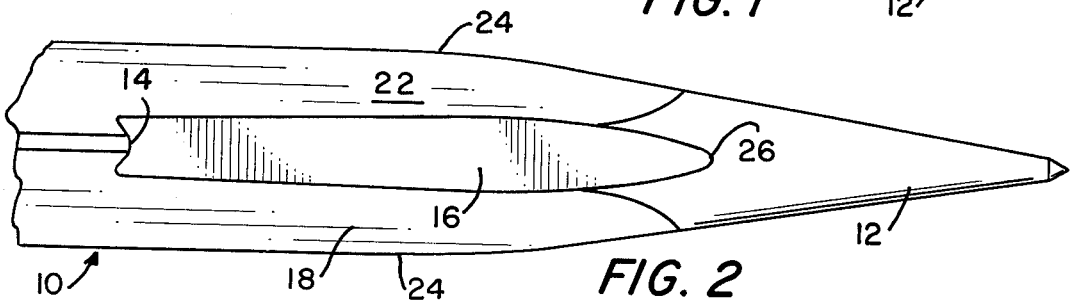
FIG. 2
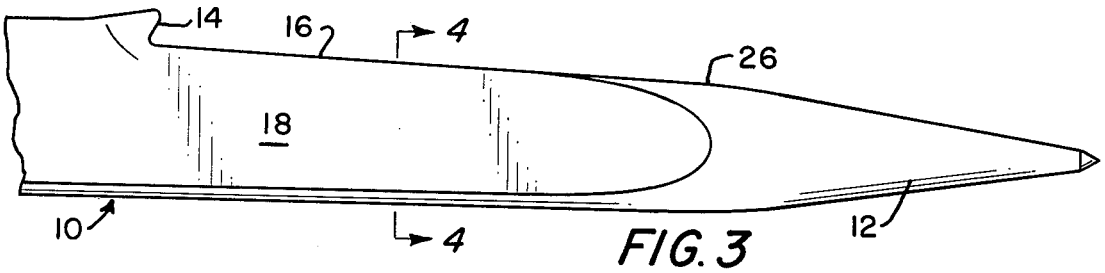
FIG. 3
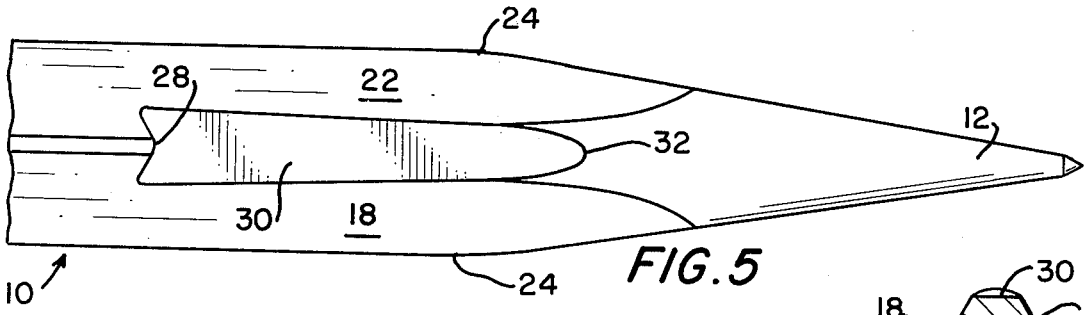
FIG. 5
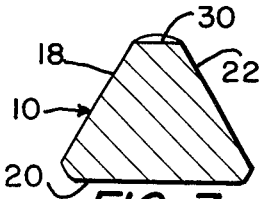
FIG. 7
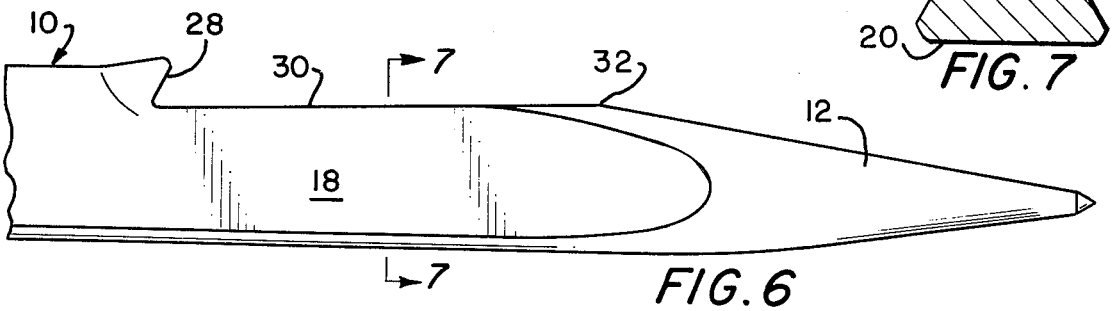
FIG. 6

FELTING NEEDLE

This invention relates to felting needles. More particularly, this invention is a felting needle having at least one barb with the throat of the barb extending into the point of the needle at an angle with respect to the axis of the needle.

Felting needles of the open barb type are especially useful because by removing all needle material from in front of the first barb of each row of barbs, the batt fibers are more easily loaded on to the barb as the needle descends into the batt. One currently used open barb design is shown in U.S. Pat. No. 3,390,440 granted July 2, 1968 to E. P. Foster. In the Foster felting needle, the material is removed from in front of the first barb on each row up to the point with the throat being parallel to the axis of the needle.

Through extensive tests and experiments, I have found that an improved open barb felting needle is made if the throat of one or more of the barbs extends into the pointed end at an angle with respect to the axis of the needle. With the throat sloping at a negative angle inward toward the axis as it progresses from barb toward point, the barb quickly and easily picks up a full load of batt fibers as the needle descends into the batt. The needle produces a smaller than normal hole in the substrata of the fabric thus causing less damage to the base fabric and resulting in a stronger final product. The undersized hole also causes the fibers to lock in more firmly when the needle is withdrawn than is the case with the larger, normal-sized holes.

In addition, the barb can be placed close to the point or tip end of the needle. This is especially desirable in very thin felted products, as a full load of fibers is deposited or distributed with very little needle penetration. Also, the speed of entry of the needle into the batt will be lower for any particular machine cycling rate than will be the speed of entry of a standard needle with the barb further back on the blade, if the barbs end their travel at the same level. This lower speed is desirable, because the more gentle action produces less fibre damage than a faster action. The lower entry speed is due to the fact that the needle board is operated on an eccentric crank with zero speed at bottom-dead-center position and the speed increasing at a geometric rate with the distance from bottom-dead-center. Alternatively, if the higher speed of entry is tolerable, the machine may be cycled more times per minute with my new needle than with the standard needle while giving equal entry speed of needle into batt. Obviously, this results in a higher rate of output of the product.

The felting needle with the throat sloping at a positive angle outward away from the axis as it progresses from the barb toward and into the point, has a different benefit. In many instances, especially when producing thicker fabrics, it is desirable not to have a full load of fibers caught on the barb with the initial penetration as would be the case with the inward sloping throat. Instead, for a more uniform distribution of fiber pickup throughout the thickness of the material, it is desirable that fibers be progressively picked up by the barb as the needle progresses through the batt. This will result in interlocking fibers from different levels of the batt.

The angle of the throat and the position of its open end and the details of the barb itself are designed to interact with the particular fiber density and fiber-to-fiber friction and other design details to produce the most desirable results in the finished felted material.

Briefly described, my new felting needle comprises a body portion having a pointed end with a least one barb with a throat extending into the pointed end. The throat surface is at an angle with respect to the axis of the body portion. This angle may be either a negative angle or a positive angle.

The invention as well as its many advantages may be further understood by reference to the following detailed description and drawings in which:

FIG. 1 is a greatly enlarged perspective view of the lower portion of the body of the felting needle;

FIG. 2 is a view of the felting needle of FIG. 1 with a plan view of a barb and throat;

FIG. 3 is a view of the felting needle of FIG. 1 and FIG. 2 with an elevational view of the barb and throat;

FIG. 4 is a sectional view taken along lines 4—4 of FIG. 3;

FIG. 5 is a greatly enlarged view showing the lower body portion of a second embodiment of my invention with a plan view of a barb and throat;

FIG. 6 is a view of the embodiment of FIG. 5 with an elevational view of the barb and throat; and FIG. 7 is a view taken along lines 7—7 of FIG. 6.

In the drawings, like parts in the various figures are referred to by like numbers.

Referring specifically to FIG. 1, my new felting needle comprises a body portion 10 having a pointed end 12. In an open barb type felting needle, usually a plurality of barbs are included around the circumference of the needle and also a plurality of rows of barbs. However, for purposes of clarity, only one barb 14 is shown in FIG. 1.

In accordance with this invention, the throat 16 of the barb 14 extends from the barb 14 into the point 12. The body portion of needle 10 behind the barb 14 is substantially triangular in cross-section. However, as shown most clearly in FIG. 4, the cross-section of the body 10 along the throat surface 16 and behind the point 12 is a truncated triangle defined by sides 18, 20, 22 and throat surface 16. The beginning of the needle point 12 is where the cylindrical surfaces between the sides 18, 20, and 22 change to conical surfaces due to the pointing-tapering of the end of the needle in an emcompassing conical shape. The needle point beginning is indicated by the number 24 in FIGS. 1, 2, and 3. The throat surface 16 extends into the point for at least a portion of the length of the point and terminates at 26 in the point 12.

In the embodiment of FIGS. 1 through 4, the throat surface forms a negative angle with the axis of the body 10, sloping inwardly toward the axis as it progresses from the barb toward the needle tip.

In the embodiment shown in FIGS. 5 through 7, the barb 28 is shown larger than the bar 14 of FIGS. 1 through 4 and the throat is shown somewhat deeper adjacent the barb 28 than the throat 16 of FIGS. 1 through 4. The throats could as easily be equal in depth or reversed in relative depth, depending on the necessary design for the felted material being produced. The throat 30 also extends into the pointed end 12 of the felting needle and ends at 32. However, instead of being at a negative angle to the axis of the body, the throat 30 extends from the barb 28 at an positive angle to the axis of the body 10, sloping outwardly away from the axis as it progresses from the barb toward the needle tip.

Although the embodiments shown illustrate barbs and throats with flat surfaces, the invention is also applicable to barbs and throats with any combination of flatted and beveled and chamfered and rounded and curved surfaces, and the connecting areas between those surfaces.

I claim:

1. A felting needle comprising: a body portion, said body portion having a pointed end and at least one barb with a throat surface extending into the pointed end, the cross section of the body portion behind the barb being substantially triangular, and the cross section of the body portion along the throat surface and behind the pointed end being a truncated triangle, the throat surface being at a negative angle with respect to the axis of the body portion.

* * * * *